US010255881B1

(12) United States Patent
Patel et al.

(10) Patent No.: US 10,255,881 B1
(45) Date of Patent: Apr. 9, 2019

(54) PRODUCTION CHARACTERIZATION OF PANEL AGING

(71) Applicant: Facebook Technologies, LLC, Menlo Park, CA (US)

(72) Inventors: Nirav Rajendra Patel, San Francisco, CA (US); Evan M. Richards, Santa Clara, CA (US)

(73) Assignee: Facebook Technologies, LLC, Menlo Park, CA (US)

( * ) Notice: Subject to any disclaimer, the term of this patent is extended or adjusted under 35 U.S.C. 154(b) by 73 days.

(21) Appl. No.: 15/381,654

(22) Filed: Dec. 16, 2016

(51) Int. Cl.
*G09G 3/00* (2006.01)
*G09G 5/10* (2006.01)
*G09G 3/20* (2006.01)

(52) U.S. Cl.
CPC ..... *G09G 5/10* (2013.01); *G09G 3/2003* (2013.01); *G09G 3/003* (2013.01); *G09G 2320/0233* (2013.01); *G09G 2320/045* (2013.01); *G09G 2320/0693* (2013.01); *G09G 2330/10* (2013.01); *G09G 2330/12* (2013.01)

(58) Field of Classification Search
None
See application file for complete search history.

(56) References Cited

U.S. PATENT DOCUMENTS

2003/0090447 A1* 5/2003 Kimura ..... G09G 3/3241 345/82

OTHER PUBLICATIONS

U.S. Appl. No. 14/969,365, filed Dec. 15, 2015, Inventors Evan Mark Richard et al.

* cited by examiner

*Primary Examiner* — Gustavo D Polo
(74) *Attorney, Agent, or Firm* — Fenwick & West LLP

(57) ABSTRACT

A display calibration system determines compensation factors for each subpixel in an electronic display to compensate for non-uniformity due to aging of the electronic display. The system takes a first measurement of the display at an input setting, instructs the display to operate an input sequence, and takes a second measurement of the display at the same input setting. The system determines one or more compensation factors for each subpixel of the electronic display based on the first measurement, the second measurement, and one or more previous characterizations of a similar subpixel on a similar display. A compensation matrix may be stored in memory on an HMD that houses the electronic display, or it may be stored in the cloud and accessed when the display is operating.

20 Claims, 8 Drawing Sheets

400

PRODUCTION CHARACTERIZATION OF PANEL AGING

BACKGROUND

The present disclosure generally relates to display devices and, more particularly, to compensating for non-uniformity due to aging of pixels for an electronic display.

Head-mounted display (HMD) systems typically include an electronic display that presents virtual reality, augmented reality, or mixed reality images. The electronic display includes pixels that display a portion of an image by combining different wavelengths of light emitted by subpixels. Subpixels experience aging, where the subpixel outputs less light over time for a given amount of applied current or voltage. Also, subpixels corresponding to different colors may age at different rates, which change the electronic display's color balance over time. Accordingly, the luminance and color balance of OLED electronic displays may be non-uniform and shift over time. Thus, present electronic displays exhibit reduced display quality over time.

SUMMARY

A display calibration system determines compensation factors for each subpixel in an electronic display for use in compensating for non-uniformity due to aging of subpixels in a same or similar electronic display. The display calibration system provides an input setting to the electronic display, requests a first measurement from a calibration device, and receives the first measurement of the electronic display at the input setting from the calibration device. The display calibration system provides an input sequence to the electronic display. After the electronic display runs the input sequence, the display calibration system provides the input setting to the electronic display, requests a second measurement from the calibration device, and receives the second measurement of the electronic display at the input setting from the calibration device. The display calibration system determines one or more compensation factors for each subpixel of the electronic display based on the first measurement, the second measurement, and one or more previous characterizations of a similar subpixel on a similar electronic display. A compensation matrix of the compensation factors for each subpixel of the electronic display is stored on an HMD that houses the electronic display or in the cloud and accessed by the HMD. The HMD includes a display calibration unit that tracks the usage of each subpixel in the display, projects an expected luminance of each subpixel in the electronic display based on the subpixel usage and the compensation factors corresponding to the subpixel in the stored compensation matrix, and determines a compensated driving condition for each subpixel to compensate for non-uniformity due to aging of each subpixel of the electronic display.

Although discussed in terms of HMD systems, the techniques for display device aging compensation described herein can be used with other display devices in order to improve display consistency and lifetime.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

System Overview

Figure 1:
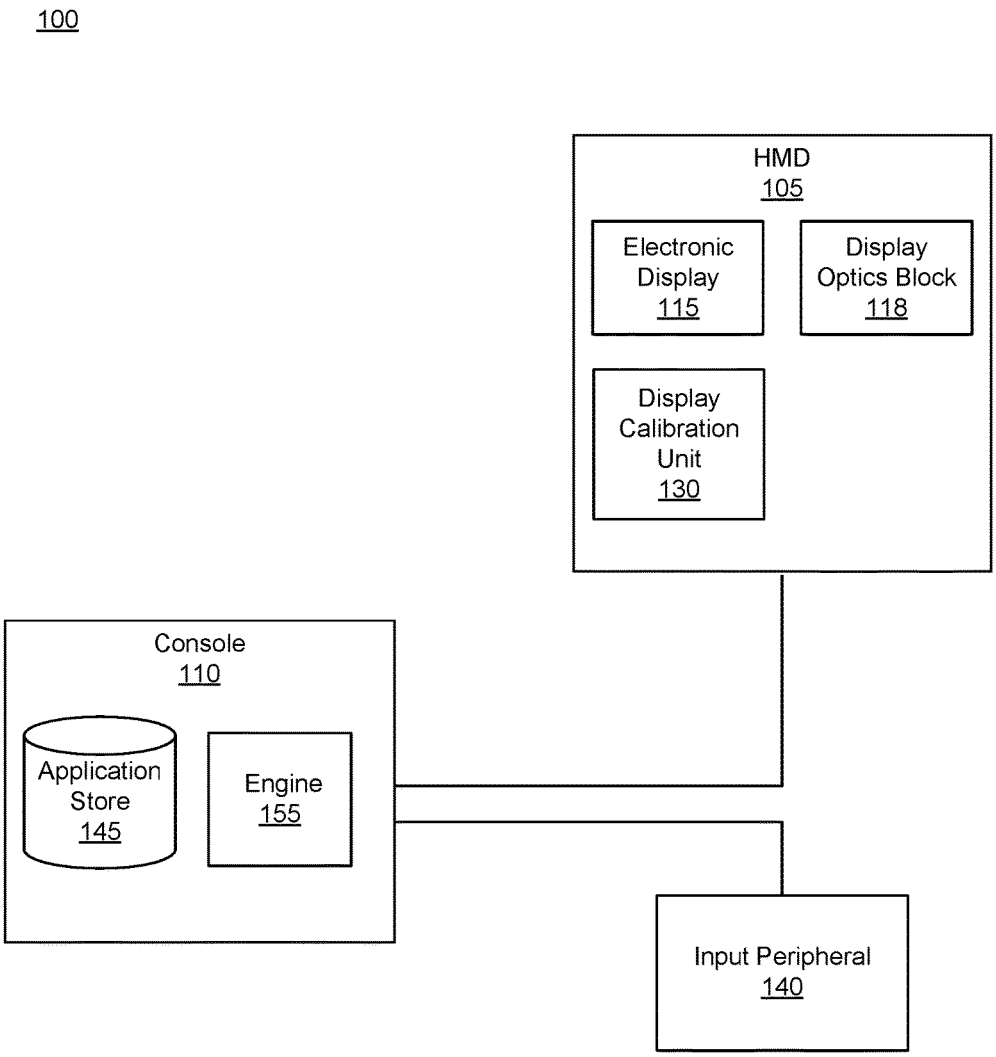
FIG. 1 is a block diagram of a system environment, in accordance with an embodiment.

FIG. 1 is a block diagram of a system environment 100, in accordance with an embodiment. The system environment 100 shown by FIG. 1 comprises a HMD 105 and an input peripheral 140 that are each coupled to a console 110. While FIG. 1 shows an example system environment 100 including one HMD 105 and one input peripheral 140, any number of these components may be included in the system environment 100, or any of the components could be omitted. For example, there may be multiple HMDs 105 controlled at least in part by one or more input peripherals 140 in communication with the console 110. In alternative configurations, different or additional components may be included in the system environment 100.

The HMD 105 is a head-mounted display that presents content to a user. Examples of content presented by the HMD 105 include one or more images, video, audio, or some combination thereof. In some embodiments, audio is presented via an external device (e.g., speakers and/or headphones) that receives audio information from the HMD 105, the console 110, or both, and presents audio data based on the audio information. An embodiment of the HMD 105 is further described below in conjunction with FIG. 2A and FIG. 2B. The HMD 105 may comprise one or more rigid bodies, which may be rigidly or non-rigidly coupled to each other together. A rigid coupling between rigid bodies causes the coupled rigid bodies to act as a single rigid entity. In contrast, a non-rigid coupling between rigid bodies allows the rigid bodies to move relative to each other.

In various embodiments, the HMD 105 includes an electronic display 115, a display optics block 118, and a display calibration unit 130. The HMD 105 may omit any of these elements or include additional elements in various embodiments. Additionally, in some embodiments, the HMD 105 includes elements combining the function of various elements described in conjunction with FIG. 1.

The electronic display 115 (also referred to as a display panel) displays images to the user according to data received from the console 110. In various embodiments, the electronic display 115 may comprise one or more display panels such as a liquid crystal display (LCD), an LED display, an OLED display, an active-matrix OLED display (AMOLED), a transparent OLED display (TOLED), or some other display. The electronic display 115 may include subpixels to emit light of a predominant color such as red, green, blue, white, or yellow. In some embodiments, the electronic display 115 renders display frames using a display driver that supplies display data to pixels arranged in rows controlled by a gate driver. The electronic display 115 may display a three-dimensional (3D) image through stereo effects produced by two-dimensional (2D) panels to create a subjective perception of image depth. For example, the electronic display 115 includes a left display and a right display positioned in front of a user's left eye and right eye, respectively. The left and right displays present copies of an image shifted horizontally relative to each other to create a stereoscopic effect (i.e., a perception of image depth by a user viewing the image).

The display optics block 118 magnifies image light received from the electronic display 115, corrects optical errors associated with the image light, and presents the corrected image light to a user of the HMD 105. In various embodiments the display optics block 118 includes one or more optical elements. Example optical elements include: an aperture, a Fresnel lens, a convex lens, a concave lens, a filter, or any other suitable optical element that affects image light emitted from the electronic display 115. The display optics block 118 may include combinations of different optical elements as well as mechanical couplings to maintain relative spacing and orientation of the optical elements in a combination. An optical element in the display optics block 118 may have an optical coating, such as an anti-reflective coating, or a combination of optical coatings.

Magnification of the image light by the display optics block 118 allows the electronic display 115 to be physically smaller, weigh less, and consume less power than larger displays. Additionally, magnification may increase a field of view of the displayed content. For example, the field of view of the displayed content is such that the displayed media is presented using almost all (e.g., 110 degrees diagonal) or all of the user's field of view. In some embodiments, the display optics block 118 has an effective focal length larger than the spacing between the display optics block 118 and the electronic display 115 to magnify image light projected by the electronic display 115. Additionally, the amount of magnification of image light by the display optics block 118 may be adjusted by adding or by removing optical elements from the display optics block 118.

The display optics block 118 may be designed to correct one or more types of optical error, such as two-dimensional optical errors, three-dimensional optical errors, or a combination thereof. Two-dimensional errors are optical aberrations that occur in two dimensions. Example types of two-dimensional errors include: barrel distortion, pincushion distortion, longitudinal chromatic aberration, and transverse chromatic aberration. Three-dimensional errors are optical errors that occur in three dimensions. Example types of three-dimensional errors include: spherical aberration, comatic aberration, field curvature, and astigmatism. In some embodiments, content provided to the electronic display 115 for display is pre-distorted, and the display optics block 118 corrects the distortion when it receives image light from the electronic display 115 generated based on the content.

The display calibration unit 130 improves the uniformity of the pixels across the electronic display 115 due to aging. The display calibration unit 130 tracks the usage of each subpixel in the electronic display 115. The display calibration unit 130 determines a modified driving condition for each subpixel based on the tracked usage of the subpixel and stored compensation factors of the subpixel. The compensation factors include information on how a subpixel degrades with usage. Thus, a luminance of a subpixel can be estimated based on the tracked usage and the compensation factors of the subpixel. The display calibration unit 130 determines a compensated driving condition based on the estimated luminance of the subpixel. The electronic display 115 is driven with the modified driving condition to compensate for non-uniformity in the electronic display 115 due to aging. Some of the functionality described with respect to the display calibration unit 130 may be performed in combination with the engine 155. The display calibration unit 130 is described further with respect to FIG. 6.

The input peripheral 140 is a device that allows a user to send action requests to the console 110. An action request is a request to perform a particular action. For example, an action request may be to start or to end an application or to perform a particular action within the application. The input peripheral 140 may include one or more input devices. Example input devices include: a keyboard, a mouse, a game controller, a glove, or any other suitable device for receiving action requests and communicating the received action requests to the console 110. An action request received by the input peripheral 140 is communicated to the console 110, which performs an action corresponding to the action request. In some embodiments, the input peripheral 140 may provide haptic feedback to the user in accordance with instructions received from the console 110. For example, the input peripheral 140 provides haptic feedback when an action request is received or when the console 110 communicates instructions to the input peripheral 140 causing the input peripheral 140 to generate haptic feedback when the console 110 performs an action. In some embodiments, the input peripheral 140 includes an external imaging device that tracks the position, orientation, or both the HMD 105.

The console 110 provides media to the HMD 105 for presentation to the user in accordance with information received from the HMD 105 and the input peripheral 140. In the example shown in FIG. 1, the console 110 includes an application store 145 and an engine 155. Some embodiments of the console 110 have different or additional modules than those described in conjunction with FIG. 1. Similarly, the functions further described below may be distributed among components of the console 110 in a different manner than is described here.

In some embodiments, the console 110 includes a processor and a non-transitory computer-readable storage medium storing instructions executable by the processor. The processor may include multiple processing units executing instructions in parallel. The computer-readable storage medium may be any memory such as a hard disk drive, a removable memory, or a solid-state drive (e.g., flash memory, dynamic random access memory (DRAM)). In various embodiments, the modules of the console 110 described in conjunction with FIG. 1 are encoded as instructions in the non-transitory computer-readable storage medium that, when executed by the processor, cause the processor to perform the functionality further described below.

The application store 145 stores one or more applications for execution by the console 110. An application is a group of instructions, that when executed by a processor, generates content for presentation to the user. Content generated by an application may be in response to inputs received from the user via movement of the HMD 105 or of the input peripheral 140. Examples of applications include: gaming applications, conferencing applications, video playback application, or other suitable applications.

The engine 155 executes applications within the system environment 100 and receives input data from the peripheral 140 as well as tracking data. The tracking data includes position and orientation data of the HMD 105, the input peripheral 140, or both. The tracking data may further include eye tracking data indicating the user's estimated or actual gaze point. Using the input data and tracking data, the engine 155 determines content to provide to the HMD 105 for presentation to the user. For example, if the received information indicates that the user has looked to the left, the engine 155 generates content for the HMD 105 that mirrors the user's movement in a virtual environment. Additionally, the engine 155 performs an action within an application executing on the console 110 in response to an action request received from the input peripheral 140 and provides feedback to the user indicating that the action was performed. The feedback may be visual or audible feedback via the HMD 105 or haptic feedback via the input peripheral 140. In some embodiments, the engine 155 performs some or all of the functionality of the display calibration unit 130.

HMD

Figure 2A:
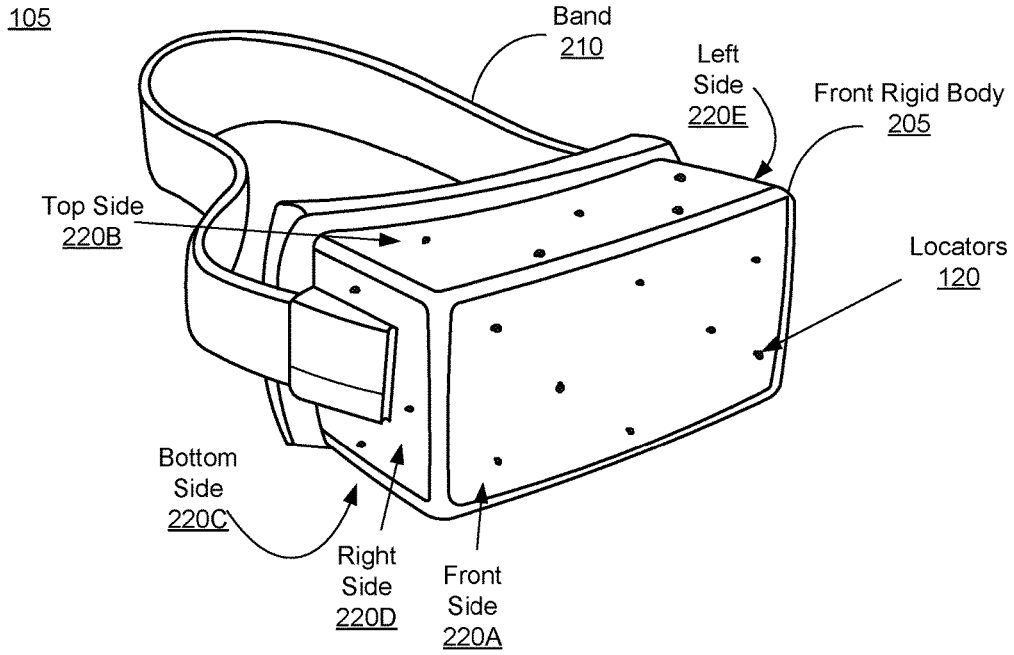
FIG. 2A is a diagram of a HMD, in accordance with an embodiment.

FIG. 2A is a diagram of one embodiment of the HMD 105. The HMD 105 includes a front rigid body 205 and a band 210. The front rigid body 205 includes the electronic display 115 (not shown in FIG. 2A) and locators 120. In other embodiments, the HMD 105 may include different or additional components than those depicted by FIG. 2A.

The locators 120 are located in fixed positions on the front rigid body 205 relative to one another. Each of the locators 120 emits light that is detectable by an external imaging device to enable tracking of the position and orientation of the HMD 105. Locators 120, or portions of locators 120, are located on a front side 220A, a top side 220B, a bottom side 220C, a right side 220D, and a left side 220E of the front rigid body 205 in the example of FIG. 2A.

Figure 2B:
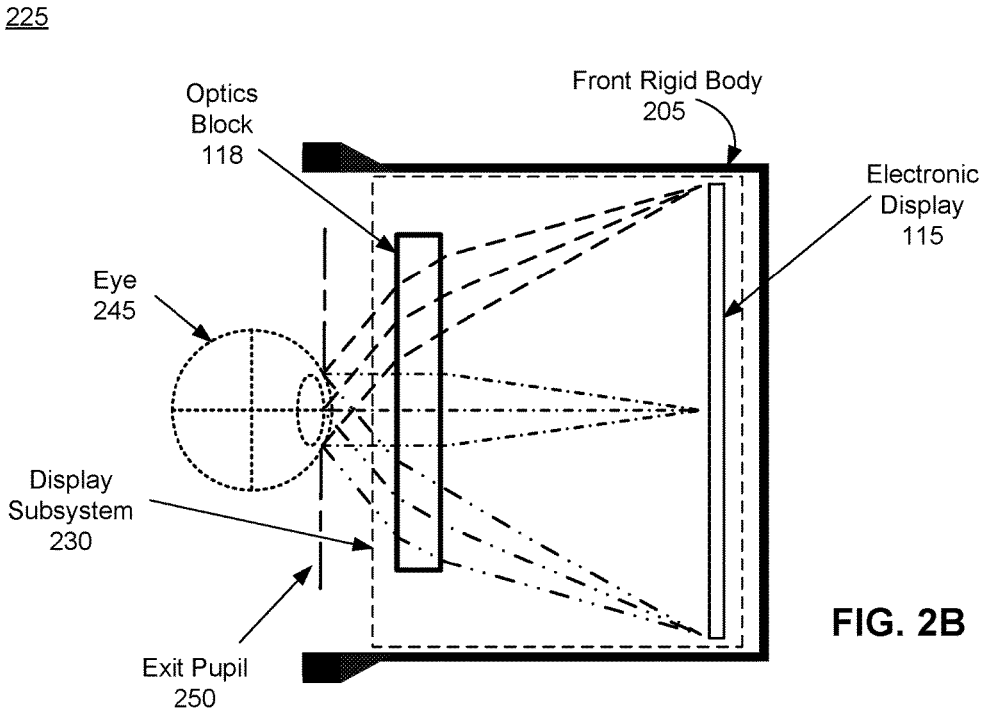
FIG. 2B is a cross-sectional view of a front rigid body of the HMD in FIG. 2A, in accordance with an embodiment.

FIG. 2B is a cross section 225 of the front rigid body 205 of the embodiment of a HMD 105 shown in FIG. 2A. As shown in FIG. 2B, the front rigid body 205 includes a display subsystem 230 that provides altered image light to an exit pupil 250. The exit pupil 250 is the location of the front rigid body 205 where a user's eye 245 is positioned. For purposes of illustration, FIG. 2B shows a cross section 225 associated with a single eye 245, but another optical block, separate from the display subsystem 230, may provide altered image light to another eye of the user.

The display subsystem 230 includes one or more electronic displays 115 and the optics block 118. The electronic display 115 emits image light toward the optics block 118. The optics block 118 magnifies the image light, and in some embodiments, also corrects for one or more additional optical errors (e.g., distortion, astigmatism, etc.). The optics block 118 directs the image light to the exit pupil 250 for presentation to the user.

Electronic Display Aging

Figure 3A:
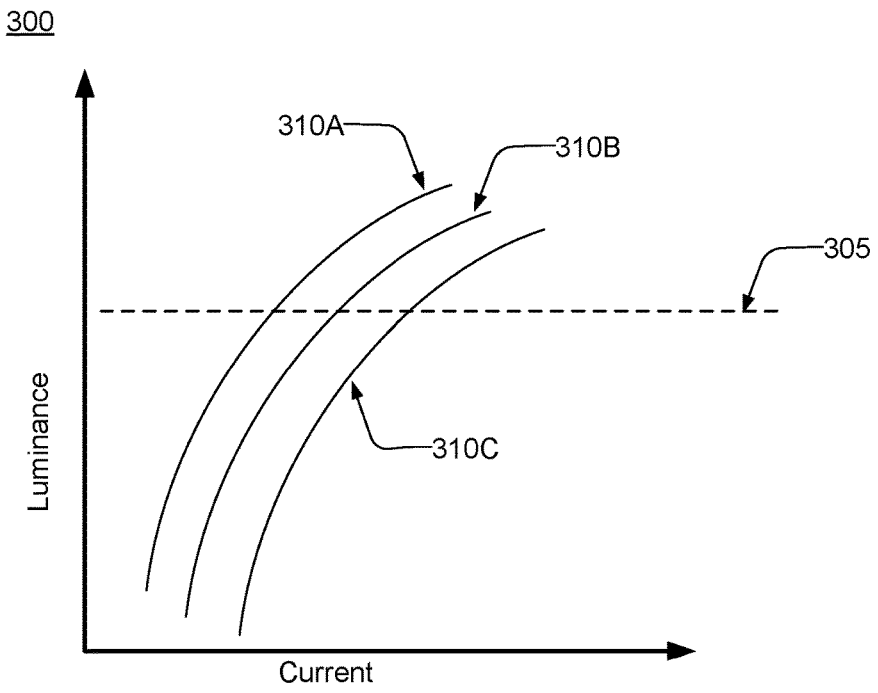
FIG. 3A is a conceptual diagram illustrating aging of the light output per driving current for an example subpixel, in accordance with an embodiment.

FIG. 3A is a conceptual diagram 300 illustrating aging of an example subpixel, in accordance with an embodiment. The diagram 300 illustrates the relationship between current through the subpixel's driving transistor and the resulting luminance of the subpixel. Curves 310A, 310B, and 310C illustrate this relationship at an initial level of usage, an intermediate level of usage, and a later level of usage, respectively. As usage increases, the luminance of the subpixel decreases when a consistent amount of current is applied. To maintain a consistent level 305 of luminance, the electronic display 115 applies an increasing amount of current or voltage to the subpixel. Thus, the HMD 105 may compensate for pixel aging by increasing the digital level, driving voltage of display data, or driving current supplied to that pixel.

Figure 3B:
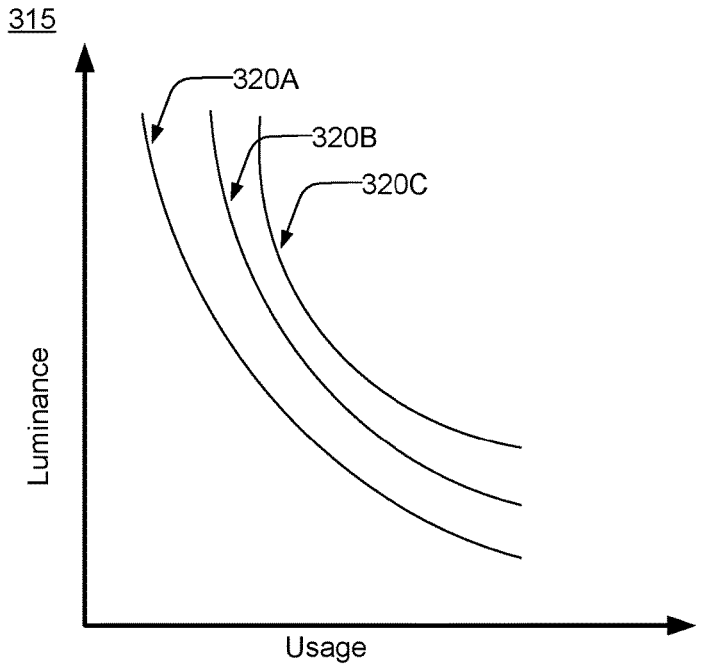
FIG. 3B is a conceptual diagram illustrating aging of different types of subpixels in an example pixel, in accordance with an embodiment.

FIG. 3B is a conceptual diagram 315 illustrating aging of different types of subpixels in an example pixel, in accordance with an embodiment. The pixel includes a blue subpixel, a green subpixel, and a red subpixel. The diagram 315 illustrates the relationship between luminance of the subpixels as usage of the subpixels increases for a consistent applied current and voltage. Usage may refer to an aging count, as determined by the display calibration unit 130 and described further with respect to FIG. 6. Curves 320A, 320B, and 320C illustrate this relationship for the blue pixel, the green pixel, and the red pixel, respectively. As the electronic display 115 drives the subpixels with the same current, the subpixels emit light with lower luminance. Since the different subpixels corresponding to different colors have different rates of luminance decay for a given amount of usage, the color balance of the pixel changes as usage increases. To maintain a consistent color balance, the electronic display 115 modifies the amount of current used to drive subpixels corresponding to different color channels. Thus, the HMD 105 may compensate for panel aging by increasing the digital level, driving voltage, driving current supplied to subpixels of one color and by decreasing the digital level, driving voltage, driving current supplied to subpixels of another color.

Figure 3C:
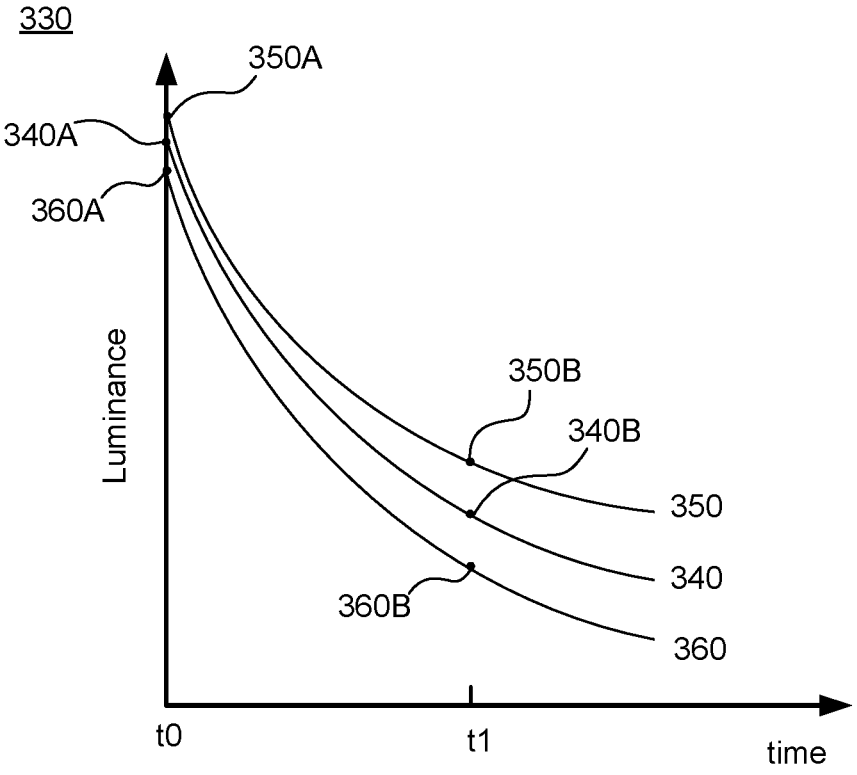
FIG. 3C is a conceptual diagram illustrating aging of different subpixels of a same type in an example panel, in accordance with an embodiment.

FIG. 3C is a conceptual diagram 330 illustrating aging of different subpixels of a same type (e.g., same color, pixel location) in an example panel, in accordance with an embodiment. Curve 340 is a characteristic degradation curve based on a previous characterization of one or more subpixels of a same type on a similar panel to the example panel. The degradation curve shows a decrease in luminance over time under an operating condition (e.g., a fixed current through the subpixel's driving transistor). The initial luminance of the subpixel under the operating condition is 340A, but over time, the luminance of the subpixel drops and after time t1 at the operating condition, the luminance is 340B. For example, curve 340 may be the average degradation curve of blue subpixels in a 2T1C panel driven at a fixed high current level. Curve 350 and curve 360 show the degradation curves for two different subpixels of the same type under the same operating condition as the one or more subpixels that produced curve 340. The subpixel that produced curve 350 started at an initial luminance level 350A that is higher than 340A, degrades at a slower rate than the characteristic degradation curve 340, and becomes a luminance level 350B after time t1. The subpixel that produced curve 360 started at an initial luminance level 360A that is lower than 340A, degrades at a faster rate than the characteristic degradation curve 340, and becomes a luminance level 360B after time t1. These differences in the initial luminance and degradation rate may be due to differences in the subpixels as a result of manufacturing of the panel. Curves 350 and 360 are only two examples of subpixels to illustrate two different combinations of initial luminance and degradation rate, but other combinations of different initial luminance and different degradation rate also exist and may result from to differences in the subpixels.

In one embodiment, the characteristic degradation curve 340 may be expressed as an exponential decay represented by $Ae^{-\alpha t}$ where A is the initial luminance of the subpixel, and $\alpha$ is the decay constant of the subpixel. Each subpixel of the same type in a similar panel may have slight variation to the characteristic degradation curve and can be represented as $A(i,j)e^{-(\alpha+\beta(i,j))t}$, where A(i,j) is the initial luminance and $\beta(i,j)$ is the compensation decay constant of the subpixel located at row i, column j of the panel.

System for Determining a Compensation Factors for an Electronic Display

Figure 4:
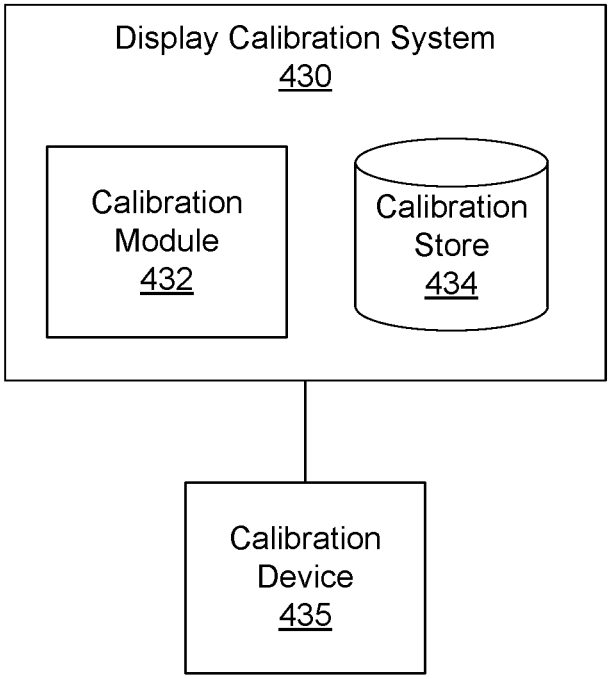
FIG. 4 is a block diagram of a system for determining the compensation factors of an electronic display, in accordance with an embodiment.

FIG. 4 shows a block diagram of a system 400 for determining the compensation factors of an electronic display 115, in accordance with an embodiment. The system 400 includes the display calibration system 430 and the calibration device 435.

The display calibration system 430 performs calibration of the electronic display 115 by characterizing an initial degradation of the electronic display 115 and determining compensation factors for the electronic display 115. The display calibration system 430 includes, among other components, the calibration module 432 for performing the calibration of the electronic display 115 and the calibration store 434 for storing the calibration data. The display calibration system 430 is located outside of a system environment of the HMD 105. The display calibration system 430 is directly connected to the calibration device 435 in the embodiment depicted in FIG. 4. However, in another embodiment, the calibration device 435 may be connected to the display calibration system 430 through a network.

In one embodiment, the calibration module 432 characterizes an initial degradation of the electronic display 115 by obtaining measurements from a calibration device 435. The calibration device 435 obtains two-dimensional information on the luminance and/or color of the electronic display 115. The calibration device 435 may be a 2D imaging colorimeter, such as those produced by Radiant Vision Systems or Konica Minolta. The calibration module 432 provides an input setting (digital setting) to the electronic display 115. The calibration module 432 requests a first measurement of the electronic display 115 at the input setting from a calibration device 435. The calibration module 432 receives the first measurement of the electronic display 115 at the input setting from the calibration device 435. Once the first measurement of the electronic display is obtained, the calibration module 432 provides an input sequence to the electronic display 115. The input sequence includes one or more digital settings for the electronic display 115 for an amount of time. For example, the electronic display 115 operates with the input sequence of a full consistent white image and equal red, green, and blue primary inputs for 96 hours. Once the electronic display 115 has completed the input sequence, the calibration module 432 provides the same input setting to the electronic display 115. The calibration module 432 requests a second measurement from the calibration device 435 of the electronic display 115 at the same input setting. The calibration module 432 receives the second measurement of the electronic display 115 at the input setting from the calibration device 435.

The calibration module 432 then determines one or more compensation factors for each subpixel of the electronic display 115 based on the first measurement, the second measurement, and one or more previous characterizations of a similar subpixel on a similar display. The compensation factors include information about how each subpixel degrades with usage. The one or more previous characterizations of a similar subpixel on a similar display may be represented by a characteristic degradation curve $Ae^{-\alpha t}$, where A is the initial luminance of the subpixel and $\alpha$ is the decay constant of the subpixel, as described in the detailed description of FIG. 3C. The calibration module 432 may determine an extrapolated degradation curve for each subpixel of the electronic display 115 based on the first measurement and the second measurement and the characteristic degradation curve. The first and second measurement provides data points on the actual degradation of each subpixel of the electronic display 115 to better characterize the degradation of each subpixel. The calibration module 432 uses information from the previous characterization of a similar subpixel to extrapolate the degradation curve of the subpixel on the electronic display 115. A similar subpixel may be a subpixel of same color, a subpixel of the same color in a similar location on a similar display panel, or a subpixel of the same color in the same location on a similar display panel. The information from the previous degradation may only include the decay constant or may additionally include the initial luminance of the subpixel. The extrapolation of the degradation curve can be done by curve fitting using standard approaches such as regression analysis or other curve fitting techniques. The extrapolated degradation curve may be a variation of the characteristic degradation curve, represented as $A(i,j)e^{-(\alpha+\beta(i,j))t}$, where A(i,j) is the initial luminance and $\beta(i,j)$ is the compensation decay constant of the subpixel located at row i, column j of the electronic display 115. The compensation decay constant $\beta(i,j)$ describes how much a pixel deviates from the characteristic decay constant. Thus, the calibration module 432 determines compensation factors for each subpixel, the compensation factors describing how each pixel degrades with usage. In one embodiment, the compensation factors for a subpixel include the initial luminance A(i,j) and the compensation decay constant $\beta(i,j)$ of an extrapolated degradation curve for the subpixel located at row i, column j of the electronic display 115.

The calibration module 432 can construct a compensation matrix that includes one or more compensation factors for each subpixel. For example, the compensation matrix may include compensation factors of the initial luminance A(i,j) and the compensation decay constant $\beta(i,j)$ for each subpixel of the electronic display 115. The compensation matrix contains information on the initial luminance of each pixel and how the pixel will age. If the operating history of a subpixel is known, the current luminance of the subpixel can be estimated by using the information in the compensation matrix and the operating history of the subpixel.

The calibration data (e.g., the first measurement, the second measurement, and the compensation matrix) may be stored in a persistent data storage of display calibration system 430 such as calibration store 434 or in a persistent data storage at a remote server. The calibration data may be at a native resolution such as at a pixel level, a subpixel level, a sampled resolution with smaller regions of interest (grid of ROIs), or by using a 2D polynomial function to represent the brightness of the display. In some embodiments, varying values of input voltage or current may be provided to each of the pixels and corresponding luminance and color outputs may be measured (e.g., as a gamma curve for each pixel). These calibration measurements may be taken a priori (e.g., at the factory during manufacturing process) and the files stored in calibration store 434 or provided separately. The stored data may be compressed using one or more compression schemes while being stored at a remote server.

Method for Determining a Compensation Factors for an Electronic Display

Figure 5:
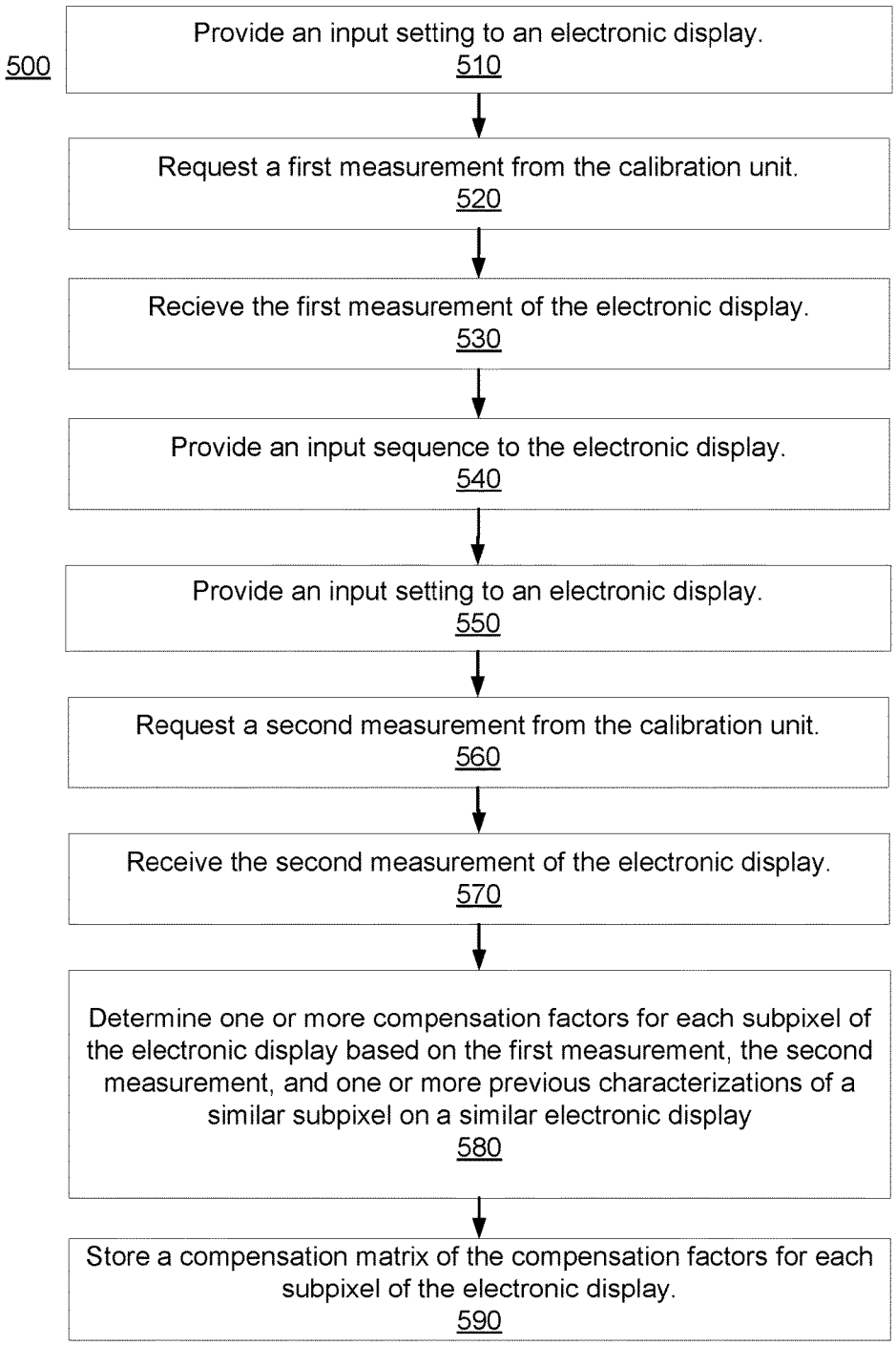
FIG. 5 is a flowchart of an example process for determining compensation factors used for correcting for non-uniformity due to aging in a display, in accordance with an embodiment.

FIG. 5 is a flowchart of an example process 500 for determining compensation factors used to correct for non-uniformity due to aging in a display, in accordance with an embodiment. In some embodiments, the method may include different and/or additional steps than those described in conjunction with FIG. 5. Additionally, in some embodiments, the method may perform the steps in different orders than the order described in conjunction with FIG. 5. The display calibration system 430 provides 510 an input setting to an electronic display 115. The input setting is a digital setting for the display. For example, the digital setting could be a digital setting to drive all the subpixels of the display at the highest display luminance level. The display calibration system 430 requests 520 a first measurement from a calibration device 435. The first measurement includes a luminance and color measurement for each subpixel of the display. The display calibration system 430 receives 530 the first measurement of the electronic display at the input setting from the calibration device 435. The display calibration system 430 provides 540 an input sequence to the electronic display. The input sequence is one or more digital settings for the electronic display for a period of time. The one or more digital settings specify pixel driving conditions over time. For example, the input sequence may be instructions to display a full bright white or an average content sweep of all pixels of the electronic display for a specific period of time (e.g., 96 hours). After the electronic display runs the input sequence, the display calibration system 430 provides 550 the same input setting to an electronic display 115. The display calibration system 430 requests 560 a second measurement from the calibration device 435. The second measurement includes a luminance and color measurement for each subpixel of the display. The display calibration system 430 receives 570 a second measurement of the electronic display at the setting from the calibration device 435. Once the first and second measurements are obtained, the display calibration system 430 determines 580 one or more compensation factors for each subpixel of the electronic display based on the first measurement, the second measurement, and one or more previous characterizations of a similar subpixel on a similar electronic display. The one or more compensation factors include information about how a subpixel degrades with usage. For example, the compensation factors may include an initial luminance of each subpixel A(i,j) and the compensation decay constant β(i,j) for the degradation of each subpixel in row i and column j of the electronic display 115. The display calibration system 430 may store 590 a compensation matrix of the compensation factors for each subpixel of the electronic display 115 in the calibration store 434 and/or a remote server.

Display Calibration Unit

Figure 6:
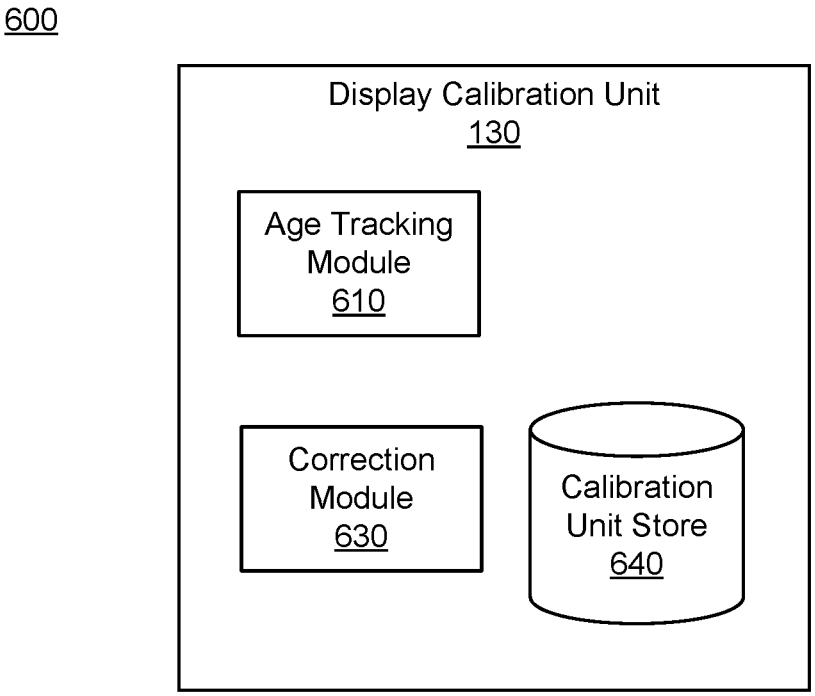
FIG. 6 is a block diagram of a display calibration unit of the HMD, in accordance with an embodiment.

FIG. 6 is a block diagram of a display calibration unit 130, in accordance with an embodiment. The display calibration unit 130 includes an age tracking module 610, a correction module 630, and a calibration unit store 640. In other embodiments, the display calibration unit 130 may include a different combination of modules to perform at least some of the features described herein.

The age tracking module 610 tracks the usage of each subpixel to determine the age of the subpixel at a driving condition. The usage of a subpixel may include different driving conditions for different amounts of time. For example, a subpixel may be driven at full brightness driving condition for a first time period t1 and then driven at half brightness driving condition for a second time period t2. In the second time period, because the subpixel operates at half brightness driving conditions, the age tracking module 610 may determine that the subpixel has aged a time of t2/2 at full brightness driving conditions in the second time period. Thus, the age tracking module 610 determines the age of the subpixel to be t1+t2/2 at full brightness driving condition. The age tracking module 610 stores the usage of the subpixel in the calibration unit store 640. The age tracking module 610 may access a previous usage value of the subpixel and store an updated usage value of the subpixel in the calibration unit store 640.

The correction module 630 determines modified driving conditions for each subpixel to correct for the effects of subpixel aging. In one embodiment, the correction module 630 estimates an aged luminance value based on the subpixel age and subpixel compensation factors. For example, the compensation factors may describe how the luminance value of a subpixel degrades with usage at full brightness driving conditions. The correction module 630 uses the subpixel age at full brightness driving condition to determine the corresponding aged luminance value from the compensation factors of the subpixel. Once the aged luminance value is determined, the correction module 630 can compute a subpixel efficiency by dividing the aged luminance value by the full brightness luminance value. The correction module 630 may determine the modified driving condition based on the subpixel efficiency. For example, if full brightness luminance value of the subpixel is 400 nits, and the aged luminance value is 200 nits, the efficiency of the subpixel is 50%. Because the efficiency of the subpixel is 50%, the correction module 630 may modify the drive conditions by driving the subpixel twice as hard to produce the desired full brightness luminance value. In a simple example where the subpixel is driven by current and the relationship between current and luminance of the subpixel is linearly proportional, the correction module 630 divides the drive current by the efficiency to produce a modified drive current at the desired full brightness luminance value. Completing the example, the correction module 630 divides the drive current by 50% and the modified drive current becomes two times the drive current to produce a subpixel with a luminance of 400 nits.

The calibration unit store 640 contains usage values of subpixels of the electronic display 115. The calibration unit store 640 may further contain the compensation matrix. For example, the correction module 630 may access the compensation matrix from a remote server and store the compensation matrix in the calibration unit store 640. Alternatively, the compensation matrix may have been stored in the calibration unit store 640 during manufacture.

In some embodiments, the functions of the display calibration unit 130 are performed in whole or in part by the console 110. For example, the HMD 105 sends subpixel usage values to the console 110, which determines and sends modified driving conditions to the HMD 105. As another example, the engine 155 performs some or all of the functionality described with respect to the correction module 630.

Embodiments of a display calibration unit and its integration into a HMD is further described in U.S. application Ser. No. 14/969,365, filed on Dec. 15, 2015, which is hereby incorporated by reference in its entirety.

Figure 7:
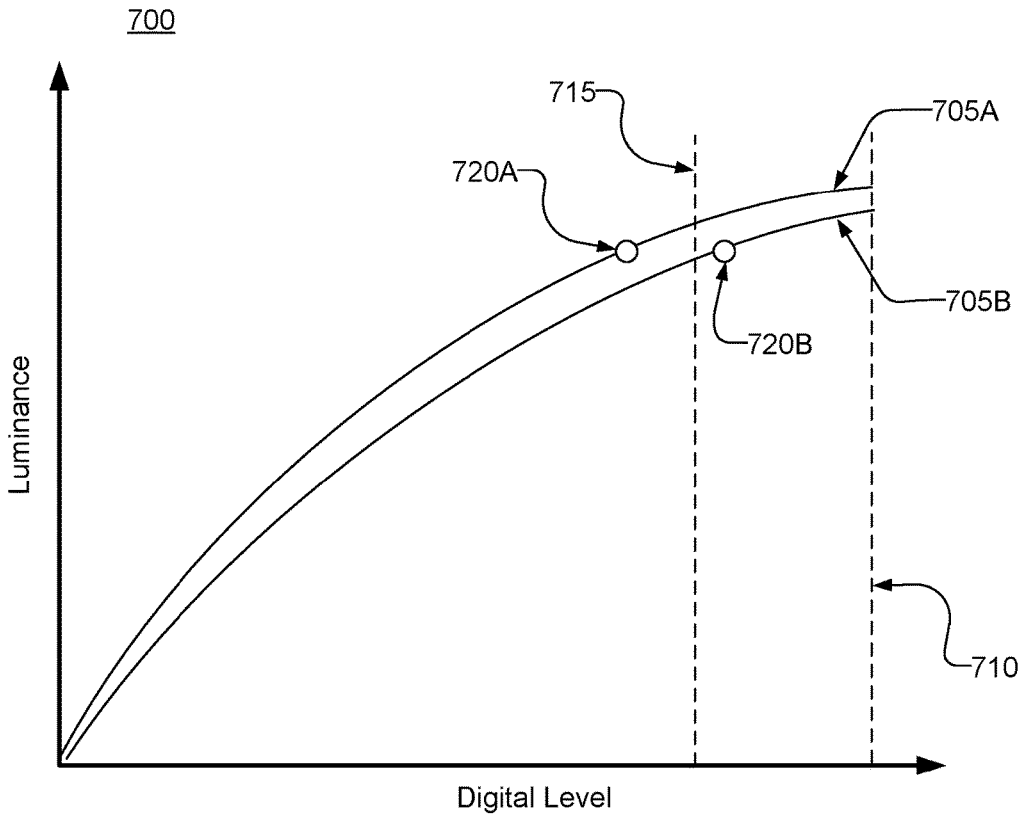
FIG. 7 is a conceptual diagram illustrating compensation for pixel aging through overdriving, in accordance with an embodiment.

The correction module 630 may output modified driving conditions that overdrives subpixels of the electronic display 115. FIG. 7 is a conceptual diagram 700 illustrating compensation for pixel aging through overdriving, in accordance with an embodiment. Curves 705A and 705B illustrate the relationship between digital level used to drive a subpixel and resulting luminance from the subpixel after initial usage and later usage, respectively. The electronic display 115 supports overdriving up to a panel threshold 710 in digital level. The console 110 sends input display driving conditions having a digital level less than an input threshold 715, which is less than the electronic display threshold 710. After the initial usage, the HMD 105 receives display driving conditions 720A at a first digital level less than the input threshold. Since the electronic display 115 has experienced minimal decay, the subpixel emits light with a luminance near that expected for the first digital level.

After later usage, HMD 105 again receives input display driving conditions at the first digital level. The correction module 630 modifies the input display driving conditions to compensate for electronic display aging and outputs modified display driving conditions 620B at a second digital level higher than the first digital level and higher than the input threshold. The subpixel emits light having substantially the same luminance as expected for the first digital level after initial usage. Overdriving the electronic display 115 thus compensates for the aging of the subpixel. By reserving an upper range in digital level for overdriving, the HMD 105 may avoid apparent aging for an increased time, thereby extending the lifetime of the electronic display 115.

Additional Configuration Information

The foregoing description of the embodiments has been presented for the purpose of illustration; it is not intended to be exhaustive or to limit the patent rights to the precise forms disclosed. Persons skilled in the relevant art can appreciate that many modifications and variations are possible in light of the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A method comprising:

drive an electronic display under an input setting;

measure a first measurement of luminance of the electronic display while driving the electronic display under the input setting;

drive the electronic display with an input sequence;

drive the electronic display under a same input setting;

measure a second measurement of luminance of the electronic display while driving the electronic display under the same input setting;

determine one or more compensation factors for each subpixel of the electronic display by extrapolating a degradation curve based on the first luminance measurement, the second luminance measurement, and a previous characterization of a subpixel on a second electronic display; and store the one or more compensation factors for use by a head-mounted display.

2. The method of claim 1, wherein the first measurement and the second measurement further comprise a measurement of color of the electronic display.

3. The method of claim 1, wherein the one or more compensation factors for each subpixel comprise a decay constant and an initial luminance.

4. The method of claim 1, wherein the one or more compensation factors for each subpixel describe a deviation of each subpixel to the previous characterization of the subpixel on the second electronic display.

5. The method of claim 1, further comprising:

store the one or more compensation factors in memory of the head-mounted display.

6. The method of claim 1, further comprising:

store the one or more compensation factors in a remote network storage accessible over a network by the head-mounted display.

7. The method of claim 1, wherein the input sequence comprises a full brightness driving condition of all subpixels of the electronic display.

8. The method of claim 1, wherein the input sequence comprises an average content sweep of all subpixels of the electronic display.

9. The method of claim 1, wherein the head-mounted display includes the electronic display.

10. The method of claim 1, wherein the head-mounted display includes any one of a block of head-mounted displays.

11. A display calibration system comprising:

a processor; and a non-transitory computer readable storage medium having instructions encoded thereon that, when executed by the processor, cause the processor to:

provide an input setting to an electronic display;

request a calibration device to take a first measurement of luminance of the electronic display at the input setting;

receive the first measurement of the electronic display at the input setting from the calibration device;

provide an input sequence to the electronic display;

provide the input setting to the electronic display;

request the calibration device to take a second measurement of a luminance of the electronic display at the input setting;

receive the second measurement of the electronic display at the input setting from the calibration device;

determine one or more compensation factors for each subpixel of the electronic display by extrapolating a degradation curve based on the first measurement and the second measurement and one or more previous characterizations of a subpixel on a second electronic display; and store the one or more compensation factors in storage accessible by a head-mounted display.

12. The display calibration system of claim 11, wherein the first measurement and the second measurement further comprise a measurement of color of the electronic display.

13. The display calibration system of claim 11, wherein the one or more compensation factors for each subpixel comprises a decay constant and an initial luminance.

14. The display calibration system of claim 11, wherein the one or more compensation factors for each subpixel are based on a deviation of each subpixel to the one or more previous characterizations the subpixel on the second electronic display.

15. The display calibration system of claim 11, wherein the non-transitory computer readable storage medium further comprises instructions that cause the processor to:

store the one or more compensation factors into a compensation matrix in memory.

16. The display calibration system of claim 11, wherein the non-transitory computer readable storage medium further comprises instructions that cause the processor to:

store the one or more compensation factors in a remote network storage accessible over a network by the head-mounted display.

17. The display calibration system of claim 11, wherein the input sequence comprises a full brightness driving condition of all subpixels of the electronic display.

18. The display calibration system of claim 11, wherein the input sequence comprises an average content sweep of all subpixels of the electronic display.

19. The display calibration system of claim 11, wherein the head-mounted display includes the electronic display.

20. The display calibration system of claim 11, wherein the head-mounted display includes any one of a block of head-mounted displays.

* * * * *